US012004582B2

(12) United States Patent
Haider et al.

(10) Patent No.: US 12,004,582 B2
(45) Date of Patent: Jun. 11, 2024

(54) EASY-LACE STRAP COMPONENT AND STRAP COMPONENT SYSTEM

(71) Applicant: Aspetto Inc., Fredericksburg, VA (US)

(72) Inventors: Abbas Haider, Sterling, VA (US); Robert Davis, Charlottesville, VA (US); Vishnu Vardhan Damacharla, New Britain, CT (US)

( * ) Notice: Subject to any disclaimer, the term of this patent is extended or adjusted under 35 U.S.C. 154(b) by 124 days.

(21) Appl. No.: 17/892,907

(22) Filed: Aug. 22, 2022

(65) Prior Publication Data

US 2023/0062029 A1 Mar. 2, 2023

Related U.S. Application Data

(60) Provisional application No. 63/236,662, filed on Aug. 24, 2021.

(51) Int. Cl.

| | |
|---|---|
| ***A41F 9/00*** | (2006.01) |
| ***A41F 9/02*** | (2006.01) |
| ***A44B 11/25*** | (2006.01) |

(52) U.S. Cl.

CPC ..... *A41F 9/02* (2013.01)

(58) Field of Classification Search

CPC ..... A41F 9/02; A44C 5/185; A44B 11/2596; A44B 11/25; A41C 1/06; F16G 3/02; F16G 3/04; A43C 1/00; A43C 11/00; Y10T 24/3734

USPC ..... 24/265 BC, 265 EC, 33 P; 403/324, 286

See application file for complete search history.

(56) References Cited

U.S. PATENT DOCUMENTS

| | | | | |
|---|---|---|---|---|
| 128,087 | A * | 6/1872 | Wright | F16G 15/06 278/96 |
| 904,416 | A * | 11/1908 | Evans | A43C 1/00 24/713.3 |
| 1,521,068 | A | 12/1924 | May | |
| 2,004,702 | A | 6/1935 | Luttman, Jr. | |
| 4,964,419 | A | 10/1990 | Karriker | |
| 5,327,823 | A * | 7/1994 | Clevenger, Jr. | F16G 3/02 100/88 |
| 5,907,912 | A | 6/1999 | Alaimo | |
| 6,128,835 | A | 10/2000 | Thatcher | |
| 8,739,373 | B1 | 6/2014 | Berman | |
| 8,973,289 | B2 | 3/2015 | Heard | |
| 10,758,008 | B2 | 9/2020 | Aihara et al. | |
| 10,807,802 | B1 * | 10/2020 | Sela | F16G 3/02 |
| 2016/0000191 | A1 * | 1/2016 | Haider | F16B 45/021 24/651 |

(Continued)

*Primary Examiner* — Jack W Lavinder

(74) *Attorney, Agent, or Firm* — Sam Pierce

(57) ABSTRACT

The present invention relates to a strap component and strap component system. The strap component has a first strap component piece and a second component piece. Each strap component piece has one or more teeth, each teeth having a base with a base width, a tip with a tip width, two side surfaces extending from the tip to the base, and a hole extending through both side surfaces. The first strap component piece and second strap component piece may be arranged whereby the one or more teeth of the first strap component piece and the one or more teeth of the second strap component piece are vertically staggered. In this arrangement, the holes of all of the teeth may be aligned whereby a connecting member may be configured through the holes to connect the first strap component piece and the second strap component piece.

18 Claims, 3 Drawing Sheets

(56) References Cited

U.S. PATENT DOCUMENTS

| | | | | |
|---|---|---|---|---|
| 2017/0215527 | A1* | 8/2017 | Vaccaro | A44B 11/2596 |
| 2018/0128348 | A1* | 5/2018 | Huels | F16G 3/00 |
| 2019/0343241 | A1* | 11/2019 | Lovato | A44B 11/25 |

* cited by examiner

EASY-LACE STRAP COMPONENT AND STRAP COMPONENT SYSTEM

This application claims priority to provisional patent application No. 63/236,662 filed on Aug. 24, 2021, which is hereby incorporated by reference.

BACKGROUND OF THE INVENTION

The present invention relates to the art of adjustable straps and buckles, such as those used in clothing, backpacks, belts, climbing gear, etc. The invention also relates to the art of lacing features such as those used in shoes, corsets, and other clothing. Furthermore, the invention relates to the art of specialty vests, such as those used by police officers, military personnel, or mountain climbers.

Many specialty vests exist in the art that comprise one or more straps that are secured around a user's waist, shoulder, or other body part. The straps present in common specialty vests in the art generally comprise two pieces that are laced together to secure the strap to a user. Lacing together the two pieces of the straps is done by a user to adjust the tightness of the fit of the strap. Lacing together the two pieces of the straps can be an arduous task due to the design of many straps that exist in specialty vests.

Many specialty vests comprise one main strap that is secured around a user's waist. In these vests, each piece of the strap comprises one or more loops through which a rope, string, lace, or cord (all referred to herein simply as a "rope") may be threaded. Threading the rope through the loops of both pieces of the strap serves to connect both pieces of the strap and thus secure it around the user's waist. Threading the rope is generally difficult to do since the loops of the pieces of the strap generally do not align with one another. Thus, the user must perform complex movements with their hands in order to thread the rope through the loops. Furthermore, the loops are generally made of the same material as the strap, and thus are generally made of fabric that does not allow loops to hold their shape. Therefore, the space through which the rope is threaded may collapse while the user is trying to thread the rope through the loop.

Due to these and other shortcomings of straps of specialty vests, there exists a need in the art for a strap component that may be attached to straps of common specialty vests and provide a manner of easily lacing both pieces of said straps together.

SUMMARY OF THE INVENTION

The present invention relates to a strap component having a first strap component piece and a second component piece. Each strap component piece may have one or more teeth, each teeth having a base with a base width, a tip with a tip width, two side surfaces extending from the tip to the base, and a hole extending through both side surfaces. The first strap component piece and second strap component piece may be arranged whereby the one or more teeth of the first strap component piece and the one or more teeth of the second strap component piece are vertically staggered. In this arrangement, the holes of all of the teeth may be aligned whereby a connecting member may be configured through the holes to connect the first strap component piece and the second strap component piece.

The tip and the base of each tooth may be parallel. The base width may be greater than the tip width whereby the side surfaces extend from the tip to the base at angles. In this manner, each tooth may be trapezoid shaped. This shape allows the teeth of the first strap component piece and second strap component piece to contact each other and slide relative to each other in order to align the holes of the first strap component piece and the second strap component piece. Furthermore, the trapezoid shape of the teeth uses less material that similar sized teeth of different shapes such as rectangles.

The hole of each tooth may have a hole diameter. The hole diameter may be sufficient to accept the connecting member. The hole diameter of each hole may be no more than ½ inch. The hole diameter of each hole may further be no more than ¼ inch. The hole diameter of each hole may further be no more than ⅛ inch. In some embodiments, each tooth may have more than one hole, which allows for options when aligning the holes of the first strap component piece and the second strap component piece.

The connecting member may be an elongated, flexible member such as a rope, string, cord, lace, or the like. When the holes of the strap component are aligned, the connecting member may be "dropped" through all the holes. This allows the first and second strap component pieces to be connected easier than other systems that utilize elongated, flexible connecting members such as shoes or corsets.

The first and second strap component pieces may also each have one or more loop openings configured opposite the one ore more teeth. Each loop opening may exist as a rectangular opening within the first and second strap component pieces. Two loop opening protrusions may extend into each loop opening to partially close each loop opening. Loops of a first strap end may be inserted into the loop openings of the first strap component piece. These loops may be held within their respective loop openings by the loop opening protrusions. Loops of a second strap end may be inserted into the loop openings of the second strap component piece. These loops may be held within their respective loop openings by the loop opening protrusions. The first and second strap end may be connected to a first and second strap, respectively. The first and second strap may be connected to a wearable article such as a tactical vest, a climbing harness, or a utility vest.

The first strap component piece and the second strap component piece may be identical. The first and second strap component pieces may have the same number of teeth. The number of teeth of each strap component piece may be at least 2. The number of teeth of each strap component piece may further be at least 3. The number of teeth of each strap component piece may further be at least 4. In embodiments wherein the first strap component piece and second strap component piece are identical, the strap component may be manufactured at a lower cost since only one die would need to be designed to manufacture the first strap component piece and second strap component piece. Furthermore, in these embodiments, the first and second strap component pieces may be used interchangeably, so if one strap component piece is lost it may be replaced with any other strap component piece rather than needing to find a strap component piece of the same design and dimensions as the missing strap component piece.

Alternatively, the first strap component piece and second strap component piece may not be identical. The second strap component piece may have more or less teeth than the first strap component piece. The second strap component piece may have more or less loop openings than the first strap component piece.

The strap component may be made of any material. In preferred embodiments, the strap component is made of injection-molded plastic. This plastic may be but is not limited to a high-density polyethylene, a low-density polyethylene, a polyurethane, or a poly-vinyl chloride. The strap component being made of injection-molded plastic allows for a high-strength, rigid device that is easy and cost-effective to manufacture. The rigid nature of the strap component allows the connecting member to be easily configured, or "dropped", through the holes of the strap component without having to manually form the first strap component piece or second strap component piece to fit the connecting member.

The present invention further relates to a strap component system that uses the strap component described thus far. The strap component system may also have a connecting member, which may be the same connecting member described thus far. The connecting member may be configured through the holes of the strap component to connect the first strap component piece and the second strap component piece. The connecting member may be held in place by a first connecting member stop and a second connecting member stop. The first connecting member stop and second connecting member stop may be knots tied from the connecting member itself. The first connecting member stop and the second connecting member stop may alternatively be spring-loaded cord locks.

In the embodiments wherein the first connecting member stop and second connecting member stop are spring-loaded cord locks, the spring-loaded cord locks may each have a hole through which the connecting member is configured. The spring-loaded cord locks may each have a piston connected to a spring whereby the spring biases the piston into the hole to close the hole. In this manner, the piston presses against the connecting member when the connecting member is configured through the hole of the spring-loaded cord lock. This holds the spring-loaded cord lock onto the connecting member.

The first connecting member stop and second connecting member stop may each have a connecting member stop diameter. The connecting member stop diameters may be larger than the hole diameters. In this manner, the first connecting member stop and the second connecting member stop may prevent the connecting member from unintentionally falling or being pulled through the holes of the strap component. The first connecting member stop may contact the first strap component piece, and the second connecting member stop may contact the second strap component piece. Alternatively, the first connecting member stop and the second connecting member stop may both contact the first strap component piece.

The strap component system may have a first strap end and a second strap end. Each strap end may have one or more loops. The loops of the first strap end and second strap end may be inserted into the loop openings of the first strap component piece and the second strap component piece, respectively. This may be done by compressing the loops, inserting them into their respective loop openings, and allowing the loops to expand within their respective loop openings. Because the loop opening protrusions partially close the loop openings, the loop opening protrusions hold the loops within the loop openings when the loops are allowed to expand within the loop openings. The loops maybe removed from their respective loop openings by again compressing the loops and removing them from their respective loop openings.

The first and second strap end may be connected to a first a second strap, respectively. The first and second strap may be connected to a wearable article such as a tactical vest, a climbing harness, or a utility vest. The first and second strap may be the same strap, or they may be different straps. The strap component may be attached to the wearable article by inserting the loops of the first strap end and second strap end into the loop openings of the first strap component piece and second strap component piece, respectively.

DETAILED DESCRIPTION

The description provided herein describes example embodiments of the present invention and is not intended to limit the invention to any particular embodiment, feature, component, size, shape, design, or any other property. Furthermore, the drawings provided herein show example embodiments of the present invention and are not intended to limit the invention to any particular embodiment, feature, component, size, shape, design, or any other property.

Figure 1:
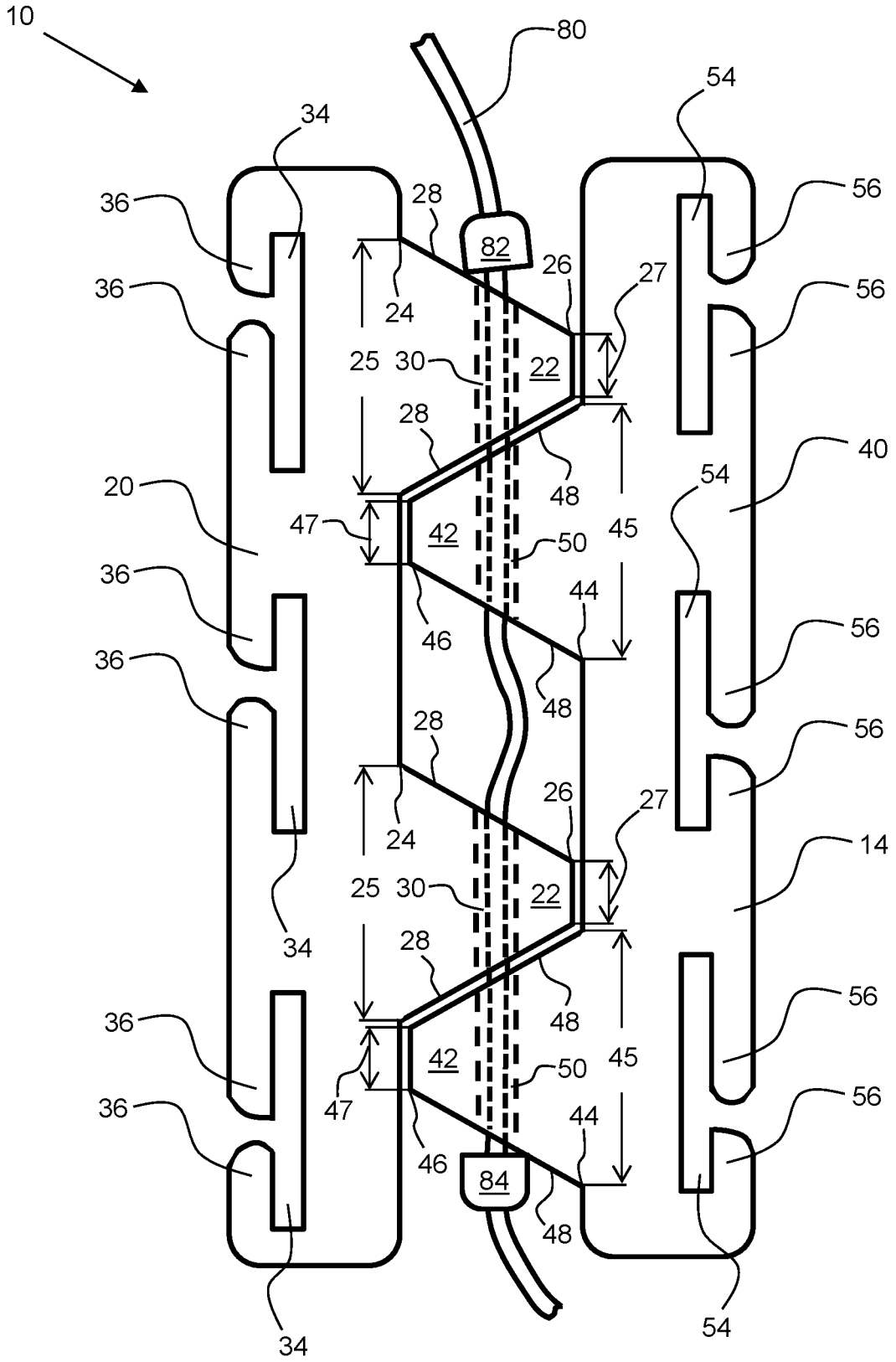
FIG. 1 shows a front view of a strap component system with a strap component having a first strap component piece and an identical second strap component piece connected by a connecting member.

As shown in FIG. 1, a strap component 14 of a strap component system 10 has a first strap component piece 20 and a second strap component piece 40. The first strap component piece 20 has two teeth 22. Each of the teeth 22 of the first strap component piece 20 has a tip 26 with a tip width 27, a base 24 with a base width 25, and two side walls 28 connecting the base 24 and the tip 26. The base width 25 is greater than the tip width 27, so the wide walls 28 are shown as extending at angles from the tip 26 to the base 24. The tip 26 and the base 24 are configured parallel to each other. Each of the teeth 22 of the first strap component piece 20 also has a hole 30. The hole 30 if each tooth 22 is shown in broken lines since the holes 30 are not normally visible from the view shown in FIG. 1.

The first strap component piece 20 has three loop openings 34 configured opposite the two teeth 22. Each loop opening 34 exists as a rectangular opening in the first strap component piece 20. Two loop opening protrusions 36 extend inwards into each loop opening 34 whereby the loop opening protrusions 36 partially close each loop opening 34.

The second strap component piece 40 shown in FIG. 1 is identical to the first strap component piece 20. The second strap component piece 40 also has two teeth 42, each having a tip 46 with a tip width 47, a base 44 with a base width 45, and two side walls 48 connecting the tip 46 and base 44 at angles. The tip 46 is configured parallel to the base 44. Each of the two teeth 42 of the second strap component piece 40 also have a hole 50. The second strap component piece 40 also has three loop openings 54, each with two loop opening protrusions 56 extending into the loop openings 54 to partially close the loop openings 54.

As shown in FIG. 1, the first strap component piece 20 and second strap component piece 40 are configured whereby the teeth 22 of the first strap component piece 20 and the teeth 42 of the second strap component piece 40 are vertically staggered. In this configuration, the holes 30 of the first strap component piece 20 and the holes 50 of the second strap component piece 40 are vertically aligned. This allows a connecting member 80 to be configured through the holes 30 and 50, thereby connecting the first strap component piece 20 and the second strap component piece 40. The connecting member 80 is held in place by a first connecting member stop 82 and a second connecting member stop 84. Also in the configuration shown in FIG. 1, some of the side walls 28 of the teeth 22 of the first strap component piece 20 are directly adjacent to some of the side walls 48 of the teeth 42 of the second strap component piece 40. Side walls 28 and 48 that are directly adjacent to each other are configured parallel to each other.

Figure 2:
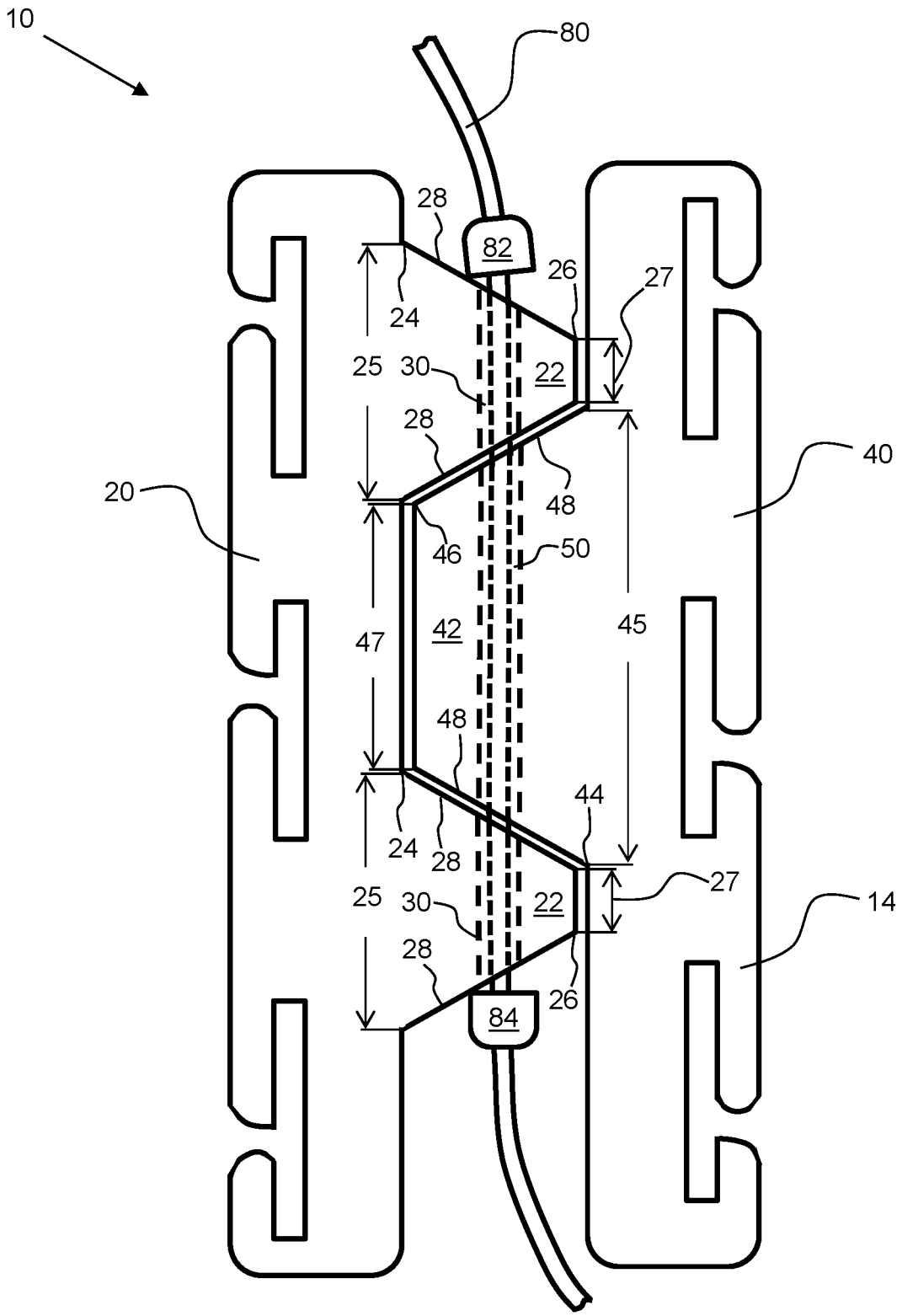
FIG. 2 shows a front view of a strap component system with a strap component having a first strap component piece and a non-identical second strap component piece connected by a connecting member.

As shown in FIG. 2, a strap component 14 of a strap component system 10 has a first strap component piece 20 and a second strap component piece 40. The first strap component piece 20 has two teeth 22, each having a tip 26 with a tip width 27, a base 24 with a base width 25, and two side walls 28 connecting the base 24 and the tip 26 at angles. The base 24 and tip 26 are configured parallel to each other. Each of the teeth 22 of the first strap component piece 20 also has a hole 30, whereby the first strap component piece 20 has a total of two holes 30.

The second strap component piece 40 as shown in FIG. 2 has one tooth 42. This tooth has a tip 46 with a tip width 47, a base 44 with a base width 45, and two side walls 48 connecting the tip 46 and base 44 at angles. The tip 46 is configured parallel to the base 45. The tooth 42 of the second strap component piece 40 also has a hole 50, whereby the second strap component piece 40 has a total of one hole 50. The tip width 47 of the second strap component piece is greater than the tip width 47 of the first strap component piece 27. The base width 45 of the second strap component piece 40 is greater than the base width 25 of the first strap component piece 20.

The tooth 42 of the second strap component piece is configured vertically between the two teeth 22 of the first strap component piece 20 whereby the holes 30 and 50 of the first strap component piece 20 and the second strap component piece 40 are vertically aligned. This allows a connecting member 80 to be configured through the holes 30 and 50, thereby connecting the first strap component piece 20 and the second strap component piece 40. The connecting member 80 is held in place by a first connecting member stop 82 and a second connecting member stop 84. Also is the configuration shown in FIG. 2, each of the side walls 48 of the tooth 42 of the second strap component piece 40 is configured adjacent to one of the side walls 28 of one of the teeth 20 of the first strap component piece 20, creating two sets of adjacent side walls. Each side wall 28 and 48 within one of these adjacent sets is configured parallel to the other side wall 28, 48. Because of the angles of the side walls, the side walls 28 and 48 of the first adjacent set are not parallel to the side walls 28 and 48 of the second adjacent set.

Figure 3:
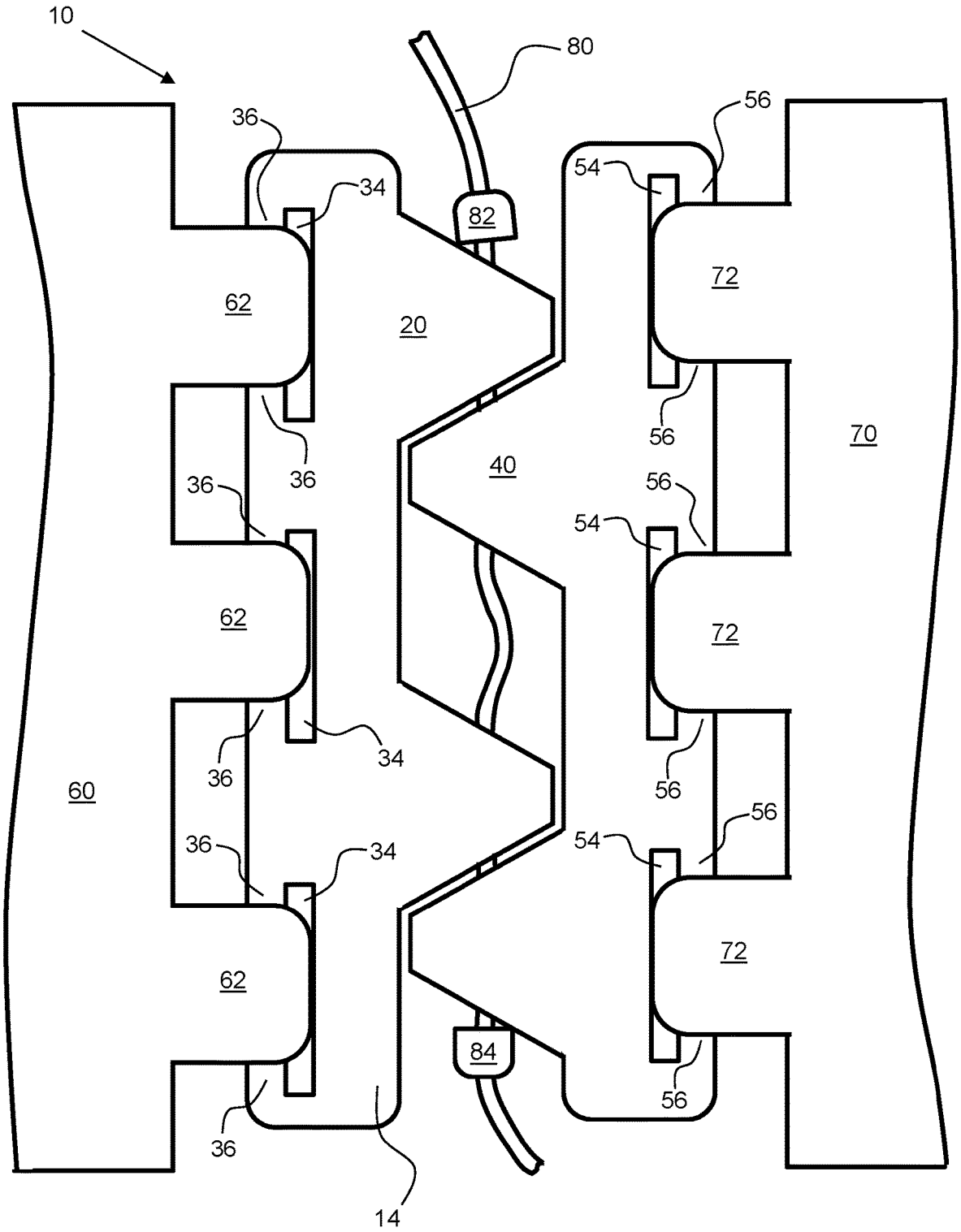
FIG. 3 shows a front view of a strap component system with a first strap end connected to a first strap component piece and a second strap end connected to a second strap component piece.

As shown in FIG. 3, a strap component system 10 has a strap component 14 with a first strap component piece 20 and an identical second strap component piece 40. The first strap component piece 20 and second strap component piece 40 are connected by a connecting member 80. The connecting member 80 is held in place by a first connecting member stop 82 that contacts the first strap component piece 20 and a second connecting member stop 84 that contacts the second strap component piece 40.

A first strap end 60 has three loops 62 that extend from the first strap end 60. Each of the three loops 62 are configured within the loop openings 34 of the first strap component 20. Each of the three loops 62 is held in place by the loop opening protrusions 36 of their respective loop openings 34. Likewise, a second strap end 70 has three loops 72 that extend from the second strap end 70. Each of the three loops 72 are configured within the loop openings 54 of the second strap component 40. Each of the three loops 72 is held in place by the loop opening protrusions 56 of their respective loop openings 54.

What is claimed is:

1. A strap component comprising:

a. a first strap component piece comprising:

i. one or more teeth, each comprising:

1. a base having a base width;

2. a tip having a tip width, wherein the tip width is parallel to the base width;

3. two side surfaces extending from the tip to the base;

4. a hole extending through both side surfaces, wherein the hole has a hole diameter;

ii. one or more loop openings, each comprising two loop opening protrusions, b. A second strap component piece comprising:

i. one or more teeth, each comprising:

1. a base having a base width;

2. a tip having a tip width, wherein the tip width is parallel to the base width;

3. two side surfaces extending from the tip to the base;

4. a hole extending through both side surfaces, wherein the hole has a hole diameter; and ii. one or more loop openings, each comprising two loop opening protrusions, wherein the one or more loop openings of each strap component piece are configured opposite the one or more teeth of said strap component piece, wherein loops of a first strap end are inserted into the one or more loop openings of the first strap component piece, wherein loops of a second strap end are inserted into the one or more loop openings of the second strap component piece, wherein the first strap component piece and second strap component piece are arranged whereby the one or more teeth of the first strap component piece are vertically staggered with the one or more teeth of the second strap component piece whereby the holes of the first strap component piece and second strap component piece are vertically aligned, and wherein a connecting member is configured through the holes of the first strap component piece and the second strap component piece thereby connecting the first strap component piece and the second strap component piece.

2. The strap component of claim 1, wherein the number of teeth of the first strap component piece is at least two.

3. The strap component of claim 2, wherein the number of teeth of the second strap component piece is equal to the number of teeth of the first strap component piece.

4. The strap component of claim 2, wherein the number of teeth of the second strap component piece is greater than the number of teeth of the first strap component piece.

5. The strap component of claim 2, wherein the number of teeth of the second strap component piece is less than the number of teeth of the first strap component piece.

6. The strap component of claim 1, wherein the base width of each of the one or more teeth is greater than the tip width of each of the one or more teeth.

7. The strap component of claim 1, wherein the hole diameters are no more than ½ inch.

8. The strap component of claim 1, wherein the hole diameters are no more than ¼ inch.

9. The strap components of claim 1, wherein the hole diameters are no more than ⅛ inch.

10. A strap component system comprising:

a. the strap component of claim 1;

b. a first strap end comprising one or more loops;

c. a second strap end comprising one or more loops;

d. a connecting member;

e. a first connecting member stop; and f. a second connecting member stop, wherein the one or more loops of the first strap end are inserted into the one or more loop openings of the first strap component piece, wherein the one ore more loops of the second strap end are inserted into the one ore more loop openings of the second strap component piece, wherein the first strap component piece and second strap component piece are arranged whereby the one or more teeth of the first strap component piece are vertically staggered with the one or more teeth of the second strap component piece whereby the holes of the first strap component piece and second strap component piece are vertically aligned, wherein the connecting member is configured through the holes of the first strap component piece and the second strap component piece thereby connecting the first strap component piece and the second strap component piece, and wherein the first connecting member stop and the second connecting member stop are configured on the connecting member to prevent the connecting member from being unintentionally removed from the strap component.

11. The strap component system of claim 10, wherein the first connecting member stop contacts the first strap component piece, and wherein the second connecting member stop contacts the second strap component piece.

12. The strap component system of claim 10, wherein the first connecting member stop and the second connecting member stop contact the strap component piece.

13. The strap component system of claim 10, wherein the connecting member is a rope.

14. The strap component system of claim 10, wherein the first connecting member stop and second connecting member stop are knots tied from the connecting member.

15. The strap component system of claim 10, wherein the first connecting member stop and second connecting member stop are spring-loaded cord locks.

16. The strap component system of claim 10, wherein the strap component system is implemented on a tactical vest.

17. The strap component system of claim 10, wherein the strap component system of implemented on a utility vest.

18. The strap component system of claim 10, wherein the strap component system is implemented on a climbing harness.

* * * * *